United States Patent [19]

Holmquist

[11] Patent Number: 4,667,356

[45] Date of Patent: May 26, 1987

[54] ADJUSTABLE INFANT BED AND SEAT

[76] Inventor: Marsha Holmquist, 605 China Basin Rd., San Francisco, Calif. 94107

[21] Appl. No.: 825,280

[22] Filed: Feb. 3, 1986

[51] Int. Cl.[4] ..... A47C 27/14; A47D 7/00

[52] U.S. Cl. ..... 5/431; 5/440; 5/449; 5/94

[58] Field of Search ..... 5/449, 450, 424, 431, 5/434, 436, 440, 490, 93 R, 94; 297/DIG. 1

[56] References Cited

U.S. PATENT DOCUMENTS

| | | | |
|---|---|---|---|
| 3,148,389 | 9/1964 | Lustig | 5/442 |
| 3,222,694 | 12/1965 | Schick | 5/440 |
| 3,840,920 | 10/1974 | Voelker | 5/450 |
| 3,968,911 | 7/1976 | Haas | 5/424 |
| 4,011,611 | 3/1977 | Lederman | 297/456 |
| 4,027,888 | 6/1977 | Wilcox | 297/284 |
| 4,171,549 | 10/1979 | Morrell et al. | 5/465 |
| 4,606,087 | 8/1986 | Alivizatos | 5/431 |
| 4,607,403 | 8/1986 | Alivizatos | 5/431 |

FOREIGN PATENT DOCUMENTS 472841 10/1937 United Kingdom ..... 5/986

*Primary Examiner*—Alexander Grosz

*Attorney, Agent, or Firm*—Harris Zimmerman; Howard Cohen

[57] ABSTRACT

An adjustable infant bed and seat includes a pillow formed of a fabric enclosure filled with expanded plastic beads. A removable outer cover is secured about the pillow, with a generally rectangular base board disposed therebetween to stabilize the shape and configuration of the assembly. A three-point safety harness is joined to the upper surface of the outer cover to secure an infant to the outer cover. The pillow filling may be variously configured as a bed which receives the infant in the prone position, or it may be rearranged as a seat to support the infant in a sitting position. In any disposition the weight of the infant compresses the beads and sustains the arranged configuration to maintain support of the infant. The pillow may be placed in a tote bag to facilitate pedestrian transport of the infant while secured to and supported by the pillow assembly.

14 Claims, 6 Drawing Figures

ADJUSTABLE INFANT BED AND SEAT

BACKGROUND OF THE INVENTION

There are known in the prior art many forms and arrangements of seats and beds for infant children. Due to the fact that infants cannot sit or raise their heads without support, a critical design feature of infant seats is that they support the infant for such purposes as feeding, napping, watching other activities, and the like. On the other hand, an infant generally should be confined when sleeping in a prone position, since they can roll in their sleep and travel laterally.

A popular form of convertible infant seat and bed includes a molded plastic frame in a generally rectangluar form, with low side walls extending from one end and both sides to form an upwardly opening coffer. An adjustable support leg extends from the bottom of the frame to support the frame on a level surface at various angles from substantially upright to fully reclined. The coffer portion usually contains a pillow which serves as a backrest for the infant when the seat is propped up on the support leg, and serves as a mattress when the seat is fully reclined so that the infant may sleep comfortably.

These plastic frame arrangements are certainly convenient and useful, yet they generally are less than comfortable. Young infants with little self-support capability tend to sag into the corners and crevices of the seat, due to the paucity of support for the child and the fact that many infants cannot coordinate the effort to regain a sitting position once they slide or slump to one side. This problem is exacerbated by the fact that the seat pillow or cushion is often covered with a spill-resistant plastic material which is smooth and slippery.

A more serious drawback to the typical plastic frame convertible baby seat is that the supporting leg and edge portion of the seat require a relatively stable and horizontal surface so that the seat is supported with stability and safety. However, many serious accidents have occurred to infants in baby seats placed in recline on tables, sofas or chairs, and the like, due to uneven support of the leg and baby seat, and the resulting collapse of the seat.

A more traditional infant bed arrangement, the basket lined with a mattress and bunting, has been updated with modern fabrics and materials and a tote-bag approach. Such arrangements are fine for an infant sleeping or resting in recline, but the infant must be removed from the basket or tote for sitting and the like. Thus an extra seat often must be brought to accompany the basket or tote. The total effort required to travel with a small child is thereby increased.

SUMMARY OF THE INVENTION

The present invention generally comprises a convertible infant bed and seat which is superior in the support provided to the infant in both sitting and laying positions. It is also lightweight and reconfigurable as a seat or bed, and is easily cleaned and maintained.

The adjustable infant bed and seat includes a pillow formed of a fabric enclosure filled with expanded plastic beads. The fabric enclosure may be formed of a generally impermeable fabric, for sanitary purposes. A removable outer cover is secured about the pillow, with a generally rectangular base board disposed therebetween to stabilize the shape and configuration of the assembly. The cover is formed of a washable, breathable fabric, for comfort and ease of cleaning. The cover also serves to retain the assembly of the pillow and the stabilizing base board.

A three-point safety harness is joined to the upper surface of the outer cover to secure the infant to the outer cover. The pillow filling may be variously configured as a bed which receives the infant in the prone position, or it may be rearranged as a seat to support the infant in a sitting position. In any disposition the weight of the infant compresses the beads and sustains the arranged configuration to maintain support of the entire body of the infant. The pillow may be placed in a tote bag to facilitate pedestrian transport of the infant while secured to and supported by the pillow assembly. The expanded plastic bead filling is extremely lightweight yet is an excellent thermal insulator.

BRIEF DESCRIPTION OF THE INVENTION

DESCRIPTION OF THE PREFERRED EMBODIMENT

Figure 1:
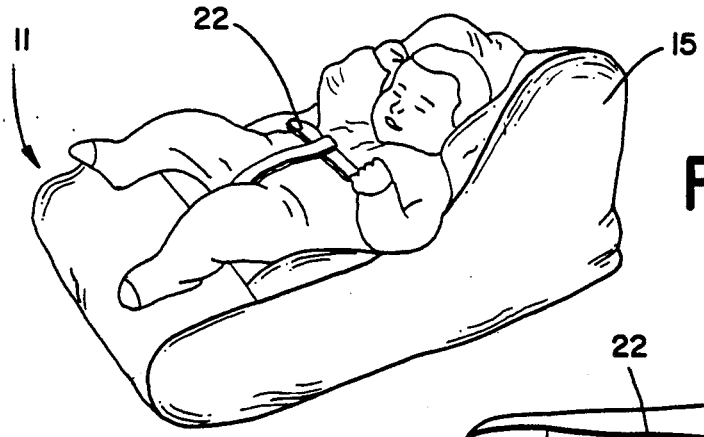
FIG. 1 is a perspective view of the convertible infant seat and bed of the present invention, shown in typical use.
Figure 2:
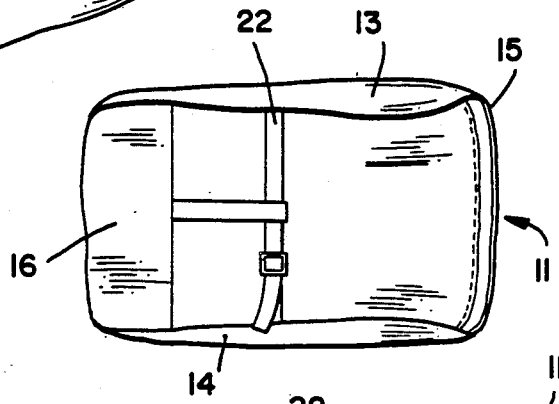
FIG. 2 is a top view of the convertible infant seat and bed of the present invention.

The present invention generally comprises a convertible infant seat and bed which is lightweight and easy to transport, yet which provides superior full body support for the infant. With regard to FIGS. 1–4 and 6, the infant seat and bed 11 of the invention includes a pillow 12 formed of a fabric enclosure and preferably filled with beads 19 of expanded plastic such as polystyrene or the like. The material which forms the fabric enclosure of the pillow may comprise an impermeable fabric such as polyvinyl or polyethylene plastic, coated Nylon, or the like. The impermeable material protects the beads 19 from contamination by liquids and organic material.

An other cover 15 is secured about the pillow 12, and is formed of a fabric which is permeable and comfortable to the touch of an infant's skin, and which is also removable and washable. The outer cover includes opposed side panels 13 and 14, and a top panel 16 sewn to confronting, parallel top edge portions of the side panels 13 and 14. A generally rectangular bottom panel 17 of the outer covering 15 is sewn to the bottom edges of the side panels, and to the end edges of the top panel to form an enclosed volume above a rectangular base. The inner pillow 12 is preferably formed of similarly configured panel sections to effect a good fit therebetween.

A stabilizer base board 18 is joined to the assembly, disposed between the bottom panel 17 of the outer cover and the respective counterpart panel of the pillow 12. The base board 18 is formed of a thin panel of resilient, relatively stiff, form retaining material such as plywood, fiberboard, plastic, and the like. The base board 18 maintains the rectangular shape of the base of the assembly. More importantly, the base board provides stable and uninterrupted support for the pillow, even though the assembly may be resting on an uneven or irregular support.

It should be noted that the outer cover not only provides a comfortable and an easily washable surface for the infant to contact, it also serves to maintain the assembly of the pillow and the stabilizer base board 18. The bottom panel 17 is provided with an open seam 21 having overlapping edges, in closed slipcover fashion, which may be expanded to remove and replace both the base board and the pillow 12.

Another important feature of the invention is the provision of a three-point safety harness 22 secured to the upper surface of the outer cover 15. The safety harness 22 secures the torso of the infant to the assembly, and prevents accidental rolling and falling of the infant, whether in the sitting or prone position. This feature permits the invention to be used to cradle and secure an infant in a location that would be otherwise dangerous; e.g., on a sofa or chair.

Figure 3:
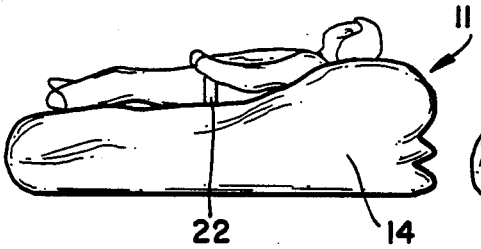
FIG. 3 is a side elevation of the invention as depicted in FIG. 1.
Figure 4:
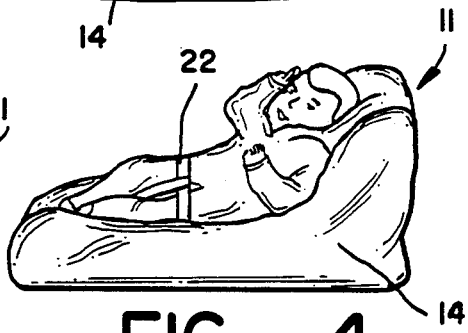
FIG. 4 is a side elevation of the present invention, shown in use configured as an infant seat.

It should be noted that the side panels 13 and 14 of the outer cover and the inner pillow may be provided with a tapered plan configuration, so that one end of the assembly tends to be higher than the other. Together with the amount of expanded plastic bead filling placed in the inner pillow, this feature permits the assembly to be reconfigurable to support the infant in a generally upright sitting position, as shown in FIG. 4. In this position the infant may be fed, and may observe the surroundings. The pillow filling easily may be redistributed manually to form a lateral bed to support the infant in a fully prone position for more comfortable sleeping, as shown in FIGS. 1 and 3. In either extreme or in any other conformal arrangement, the plastic beads retain their desired arrangement due to the compressive effect of the weight of the infant. Furthermore, the plastic bead filling tends to conform to the body contours of the infant, thereby providing generally full-body support to an individual who really requires such support. Other side panel configuration may be used by those skilled in the art to form a comfortable pillow enclosure without departing from the scope of this invention.

Figure 5:
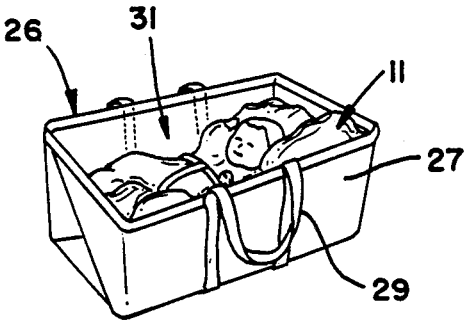
FIG. 5 is a perspective view of a tote bag for use in carrying the convertible infant seat and bed arrangement of the present invention.
Figure 6:
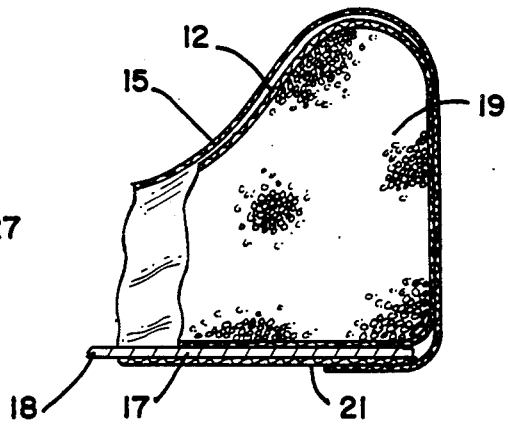
FIG. 6 is an enlarged partial cross-sectional elevation of the pillow, cover, and stabilizer base panel assembly of the present invention.

The convertible bed and seat of the present invention may be transported easily in a tote bag, one preferred form of which is shown in FIG. 5. The bag 26 is generally formed as a rectangular coffer opening upwardly, with side walls 27 higher than the greatest height of the assembly 11. A rolled or folded edge of other stiffening means at the upper edge of the bag 26 provides sufficient stiffness to maintain the shape of the bag together with stiff triangular panels folded into the end walls to prevent collapse of the sides onto the infant. A pair of strap loops 29 are joined to the opposed sides of the bag to facilitate carrying. The inner volume 31 of the bag is configured similarly to the outer shape of the assembly 11, so that the assembly 11 may be reshaped in conjunction with the lateral support of the sides and ends of the tote bag 26.

It should be noted that the assembly 11 is extremely lightweight, due to the low density of the expanded plastic beads and the lightweight fabrics used. The tote bag may be formed of canvas or Nylon fabric, or may be made of woven basket material. In any case the combined weight of the assembly 11 and the tote 26 is surprisingly low.

I claim:

1. A convertible infant bed and seat, comprising;

an inner pillow assembly including pillow stuffing means which is resilient, reshapable and reconformable, stabilizer base board means both for maintaining a predetermined shape of said inner pillow and for providing substantially continuous support of the bottom of said inner pillow, outer cover means both for providing a removable and washable outer cover for said inner pillow and for maintaining the assembly of said inner pillow and said stabilizer base board means, wherein said inner pillow is filled to a degree sufficient to provide stable support for an infant and to be redistributable and reconfigurable to form an infant seat to support an infant in generally upright posture, or to form a lateral bed to support an infant in fully reclined disposition.

2. The assembly of claim 1, wherein said inner stuffing means comprises a mass of expanded plastic beads.

3. The assembly of claim 1, wherein said stabilizer board means includes a generally flat panel formed of a relatively stiff, resilient form-retaining material.

4. The assembly of claim 3, wherein said flat panel is provided with a perimeter edge shape similar to the bottom configuration of said inner pillow.

5. The assembly of claim 4, wherein said outer cover means includes an outer cover formed in closed slipcover fashion dimensioned to receive said inner pillow therein, with said flat panel disposed between said inner pillow and said outer cover.

6. The assembly of claim 5, wherein said inner pillow comprises a fabric enclosure formed of a generally impermeable fabric, and said outer cover is formed of a breathable, washable fabric.

7. The assembly of claim 5, wherein said outer covers includes an opening adapted for removal and replacement of said flat panel and said inner pillow.

8. The assembly of claim 5, wherein said outer cover further includes strap means secured to an upper portion of said outer cover and disposed to secure and retain an infant thereto.

9. The assembly of claim 1, wherein said inner pillow is filled to a degree sufficient to provide stable support for an infant and to be redistributable and reconfigurable to form an infant seat to support an infant in generally upright posture, or to form a lateral bed to support an infant in fully reclined disposition.

10. The assembly of claim 1, further including tote bag means adapted to enclose and transport the assembly of said inner pillow, said stabilizer base board means, and said outer cover means.

11. The assembly of claim 10, wherein said tote bag means includes a basket-like bag having an upwardly opening coffer dimensioned to receive said assembly of said inner pillow, said stabilizer base board, and said outer cover means.

12. The assembly of claim 1, wherein said inner pillow includes a fabric enclosure having a pair of opposed fabric side panels, said side panels including a tapered configuration to define a pillow having opposed end portions with one end portion generally higher than the other.

13. The assembly of claim 12, wherein said inner pillow fabric enclosure includes a generally rectangular bottom panel joined to said side panels, and said stabilizer base board means includes a base panel having an outer edge configuration substantially similar to said bottom panel of said inner pillow.

14. The assembly of claim 13, wherein said outer cover means includes an outer fabric covering dimensioned to fit closely said inner pillow, said outer fabric covering including bottom and side panels dimensioned substantially similar to respective counterparts of said inner pillow.

* * * * *